United States Patent [19]

Brawley

[11] 4,292,765

[45] Oct. 6, 1981

[54] MACHINE FOR ABRADING OUTSIDE DIAMETERS AND THE METHOD OF MAKING SAME

[76] Inventor: Thomas S. Brawley, P.O. Box 82, Middletown, Conn. 06457

[21] Appl. No.: 24,004

[22] Filed: Mar. 26, 1979

Related U.S. Application Data

[63] Continuation-in-part of Ser. No. 876,994, Feb. 13, 1978, abandoned.

[51] Int. Cl.[3] ..... B24B 5/18

[52] U.S. Cl. ..... 51/103 TF; 51/289 R

[58] Field of Search ..... 51/5 D, 103 R, 103 TF, 51/103 WH, 108 R, 131.2, 289 R; 125/11 CD

[56] References Cited

U.S. PATENT DOCUMENTS

| | | | |
|---|---|---|---|
| 1,649,713 | 11/1927 | Lofquist | 51/123.6 |
| 1,926,974 | 9/1933 | Einstein | 51/108 R |
| 3,078,835 | 2/1963 | Thomas | 51/103 TF X |
| 3,365,842 | 1/1968 | Lohmeier, Jr. | 51/108 R |
| 4,062,150 | 12/1977 | Masuda et al. | 51/5 D |

*Primary Examiner*—Gary L. Smith
*Assistant Examiner*—Robert P. Olszewski
*Attorney, Agent, or Firm*—James W. Gould

[57] ABSTRACT

An improved machine and method for grinding outside diameters. A plurality of workpieces are fed via workpiece guides into aligning contact with a rotational abrading wheel and a plurality of corresponding workpiece supports. The workpiece supports are rotatably mounted in a concentrically positioned housing which is driven in counter rotation to the abrading wheel, regulating rotation of the workpiece via engagement between a ring gear and a gear connected to one end of each workpiece support, thereby giving the workpieces a counter-planetary revolution that is concentric to the periphery of the abrading wheel, thereby enabling effective surface grinding speeds which exceed existing speed barriers. The housing is also slidably axially mounted responsive to pressure means to automatically adjust the positions between the workpiece supports and abrading wheel as wear occurs. The housing which provides 360° enclosure of the abrading wheel also provides protection against explosive fragmentation of the abrading wheel, and the multiple workpiece supports allow simultaneous grinding of multiple workpiece on a single abrading wheel.

21 Claims, 9 Drawing Figures

MACHINE FOR ABRADING OUTSIDE DIAMETERS AND THE METHOD OF MAKING SAME

This application is a continuation-in-part of now abandoned application Ser. No. 876,944 filed Feb. 13, 1978.

BACKGROUND OF THE INVENTION

Traditional methods of outside diameter grinding and lapping employ a variety of machinery, each of which have certain inborn limitations relative to productivity. For example, although there are an infinite number of tangential contact points about the circumference of an abrading wheel, conventional outside diameter grinding and lapping machinery utilize only one of these points in the abrading process. Centerless through feed grinding and other types of grinding improve on this somewhat by extending one such tangential point in a generally axial direction so that several workpieces may be ground simultaneously by feeding the workpieces single file in an axial direction. Nevertheless, many other tangential points around the circumference of the abrading wheel could be utilized to effect increased productivity.

One object of this invention is therefore to provide a means of increased productivity in grinding or lapping outside diameters by simultaneous operation of the abrading cycles of a plurality of workpieces from a plurality of such points on the abrading wheel.

Another factor that has for years limited productivity in this field is the maximum attainable speed of an abrading wheel. Those who are skilled in the art generally refer to the abrading wheel speed in terms of "surface feet per minute." (SFPM) For a given abrading wheel RPM, as the abrading wheel is reduced in diameter, the surface feet per minute is reduced so that the abrasive efficiency is also reduced.

Notably, abrading wheel speeds have been limited due to certain restrictions on the RPM that are brought about by centrifugal force. At high velocities, the effect of certrifugal force may actually exceed the bond strength of the abrading wheel. The result is an outward explosion of abrading wheel fragments. As a result, a speed barrier currently exists in high speed grinding or lapping. Depending upon the type of abrading wheel which is used, the barrier generally occurs at surface speeds above about 24,00 SFPM. The actual safe operational speeds for high speed grinding wheels, however, are considerably less than the above stated 24,000 SFPM since the American Standard Safety Code Publication (ANSI-B 7.1-1970) requires that such abrading wheels be tested at the manufacturer's plant at 50% overspeed. Thus, the above stated 24,000 SFPM abrading wheel would be permitted to operate at only 16,000 SFPM.

In addition to the theoretical limit described above, in shipment, or in shop floor handling, the abrading wheel may develop undetectable hair-line cracks from rough transport. The result is again an outward explosion of abrading wheel fragments when the abrading wheel is put to use, even at SFPM otherwise considered safe. Manufacturers of high speed abrading machinery are therefore increasingly aware of the need for shatterproof enclosures which guard against the possibility of such explosions, whether due to centrifugal force or cracks. The logical solution of first impression to this problem appears to be simply increasing the bond strength of the adhesive holding the abrading particles together. However, abrading wheels having a high bond strength are not necessarily the answer since they too have a limitation. The limiting factor, in this instance, occurs when the abrasive of the abrading wheel has become dull due to the excessive length of time which an overly strong abrading wheel bond may hold the enbonded abrasive. A variety of workpiece quality problems will then follow, as well as substantial reductions in the abrasive efficiency of the abrading wheel.

Another object of this invention is therefore to provide a means of attaining effective surface feet per minute speeds between the abrading wheel and workpiece surfaces that are greater than that attainable by rotation of the abrading wheel alone. In attaining surface speeds greater than those of the conventional art, it may be seen that a further object of the invention is to attain greater surface speeds in a safer manner.

Another limitation inherent to traditional grinding and lapping is the repeatability of sizing accuracy of the workpieces. Difficulty arises when the abrading wheel is reduced in diameter by either wear or by a resurfacing process that is commonly referred to as truing. In order to maintain contact, it is then necessary to move either the workpiece to the abrading wheel, or vice versa. This repositioning in a radial direction, is referred to as "abrading wheel compensation."

Extreme accuracy is required when compensating either the abrading wheel or the workpiece. In either instance, however, a heavily weighted housing which rests on a slide, normally supports the compensated element to act against vibration. The weight of the compensated element combined with a gathering of spent abrasive on worn machine components, may resist movement from intermittent mechanical stimuli. When compensation finally does occur, the machine may have a tendency to overcompensate beyond the required minute tolerance. Subsequent sorting operations are then necessary to segregate out-of-tolerance workpieces.

In the instance where the abrading wheel diameter has been reduced by the aforementioned truing process, accurate compensation of the abrading wheel resurfacing tool is also required. Those who are skilled in the art commonly refer to this latter process as "diamond compensation" since the resurfacing tool generally comprises substantial quantities of industrial quality diamonds. Notably, this latter compensation also occurs in a radial direction relative to the abrading wheel when performed in conventional grinding or lapping.

It is therefore a further object of this invention to provide a means of automatic abrading wheel compensation which is not affected by a gathering of spent abrasive on a mechanical slide or by intermittent mechanical stimuli from a radial direction. Since abrasive debris is commonly a problem with such machinery, it is a further object of the invention to reduce wear from abrasion by improving the design of certain other working mechanical members.

SUMMARY OF THE INVENTION

All of the above objects can be accomplished by the present invention. The use of a multiplicity of points on the abrading wheel is accomplished by an axially free-floating housing positioned concentric to the abrading wheel. The housing provides support and alignment for a plurality of workpieces which may be arrayed about the entire circumference of the abrading wheel rather than a single point or an arc portion as taught by the prior art. Lohmeier, U.S. Pat. No. 3,365,842 illustrates previous attempts to accomplish this object. Lohmeier, however, can only utilize an arc portion of the abrading wheel due to the eccentric positioning of the workpiece with respect to the axis of the abrading wheel. The result is that only one workpiece may be finished at a time. The present invention which concentrically positions workpieces about the circumference of the abrading wheel may have a plurality of workpieces finished simultaneously. In fact, the present invention may abrade as many workpieces as will fit around the circumference of the abrading wheel.

Further, Lohmeier is not applicable to through feed grinding, and requires a workpiece having a "generally axially extending internal opening" (col. 3 ls. 69–70) to provide for alignment and rotation of the workpiece about its axis. The present invention avoids these limitations. (Einstein, U.S. Pat. No. 1,926,974 does not illustrate simultaneous usage of a plurality of abrading wheel contact points. Rather, it shows means for rotating multiple workpieces sequentially into contact with a single contact point to abrade only end surfaces and not outside diameter surfaces.)

The object of increased effective speed of the abrading wheel is accomplished by driven concentric revolution of the axis of the workpiece about the abrading wheel circumference in a planetary and counter-directional motion to the normal rotation of the abrading wheel, while the workpiece itself, in contact with the abrading wheel is simultaneously rotated about its own axis, preferably in an opposing direction to that of the abrading wheel. The resulting effective abrasive wheel speed is the sum of the differential rotational speeds of the workpiece and abrading wheel, plus the counter planetary movement of the workpiece about the abrading wheel, resulting in greater abrasive efficiency.

Lohmeier, U.S. Pat. No. 3,365,842 illustrates an inferior means of inducing counter-revolution of the axis workpiece by use of a cogged flexible drive belt which rotates counter to the abrading wheel direction of rotation. Eccentric circumferential movement of the workpiece axis is provided by spindles on a separate drive belt, which are absent in the present invention. Lohmeier's arrangement also does not allow the high counter-revolutionary speeds of the workpiece necessary to achieve the object of the present invention of higher abrading efficiency. The present invention accomplishes the high counter-revolutionary speeds of the workpiece by a 360 degree counter-rotative housing, having at least two workpiece supports. In addition, the housing encompasses the abrading wheel by 360 degrees and also encloses the abrading wheel on at least one end. The result provides a highly desirable shatterproof enclosure to guard against the explosive capacities of high speed grinding or lapping. The object of safer high speed grinding or lapping is thereby accomplished.

With respect to the object of improved abrading wheel compensation, this commonly takes place when at least two generally cylindrical centerless regulating wheels or workpiece supports are repositioned axially into the direction of the abrading wheel. The function of a regulating wheel is to support the workpiece, to regulate the workpiece size, to regulate the workpiece speed of traverse and to regulate the spped of workpiece rotation by serving as a brake to prevent the workpiece from achieving the same speed of rotation as the abrading wheel. Although each of these functions are performed in the traditional manner in the present invention, it offers a distinct improvement over the conventional art in that the compensated regulating wheels of the present invention are firmly affixed to bearings that are set in a 360 degree counter-rotative axially free-floating housing. The regulating wheels are therefore planetarily counter-revolved about the periphery of the abrading wheel. Such bearings may be a pressed fit rolling type, or any other conventional bearing means. The housing, having an inside diameter concentric to that of the abrading wheel, functions in counterpart with an opposing, concentrically positioned abrading wheel. In the preferred embodiment, the abrading wheel has been tapered so that when an axial pressure is applied, the axes of the regulating wheels therefore assume a self-aligning tapered alignment to the tapered abrading wheel as a series of generally cylindrical workpieces are fed between the former and latter.

Unlike the conventional aforementioned housing that moves from a slide, the compensated housing of the present invention utilizes a rolling, free-floating axial movement. This motion has a greater sensitivity to achieve accurate adjustment and greater resistivity to wear from abrasive build up. With the application of constant axial pressure to the feed end of the regulating wheel housing, the present invention functions in a state of constant compensation. Even minute reductions in the abrading wheel diameter will result in simultaneous ultra-precision compensation. As an alternative, however, the present invention may compensate the abrading wheel with a constant axial pressure rather than compensating the regulating wheel housing. Nevertheless, the amount of pressure that is required to provide for proper compensation should be enough to move the housing and overcome the problem of vibration.

With respect to the object of improved truing, in the present invention the diamond truing tools revolve in a 360 degree rotation with, but also have a movement independent of, the aforementioned axially free-floating housing or regulating wheel housing. The diamond truing tools of the present invention are designed in roll form and are positioned in a generally concentric relationship to the tapered abrading wheel. These resurfacing tools are also firmly affixed to support the independent axially free-floating housing which is concentrically positioned on the outside diameter of the regulating wheel housing. The regulating wheel housing, however, allows the diamond truing tools to protrude through it, by means of at least two axially slotted openings, having a length at least equal to the abrading wheel length, to provide for the resurfacing of the abrading wheel by the diamond tools.

Extremely accurate diamond tool compensation is provided when, upon a given impulse from conventional means, a preset axial pressure is exerted on the end of the diamond housing where the workpiece feed occurs and the diamond truing tools begin to engage the contact of the abrading wheel. Upon a second impulse, also from conventional means, the diamond truing tools will begin to retract to a position which is concentric to, but just out of contact with, the abrading wheel in a manner not disclosed in the prior art. Lofquist, U.S. Pat. No. 1,649,713, for example, is inapposite because it does not disclose an axially free-floating housing to which the diamond tool is affixed. Thomas, U.S. Pat. No. 3,078,835 only teaches the method of feeding a truing tool in the shape of a cylindrical workpiece through a centerless grinder.

Description of the Preferred Embodiments

Figure 8:
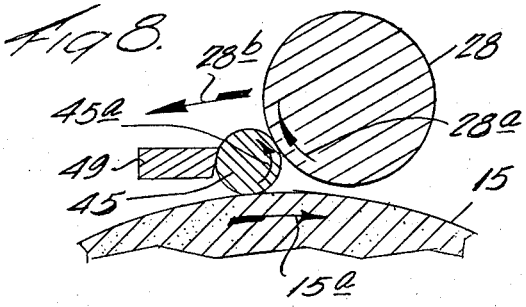
FIG. 8 is a transverse fragmentary sectional view taken on the line 8—8 of FIG. 6 showing respective positions of the guide bar, workpiece, regulating wheel and grinding wheel and the relative direction of rotation of each member.

Referring to the drawings, the improvement over the prior art of centerless through feed grinding and lapping and the present invention is schematically illustrated in FIG. 8, wherein abrading wheel 15 rotates about its axis in the clockwise direction of the arrow 15*a*. Workpiece 45, having engaged into abrading contact with abrading wheel 15, rotates accordingly about its axis in a counterclockwise direction as shown by arrow 45*a* in the prior art. Work rest blade 49 supports workpiece 45 throughout the abrading process. The positive contact that is provided by abrading wheel 15 drives workpiece 45 against regulating wheel 28, which in the prior art serves as a brake for the workpiece 45 while rotating at a reduced speed in a clockwise direction as shown by arrow 28*a*.

In the present invention, rotation of the aforementioned housing 20 causes regulating wheel 28 to revolve in a planetary fashion about abrading wheel 15 in the direction of arrow 28*b*. This planetary rotation causes the effective SFPM of the abrading wheel to be increased by the additive velocity of the counter planetary revolution of the workpieces, thereby increasing the abrading efficiency. Regulating wheel 28 preferably continues to act as a brake to prevent any increased rotation of the workpiece in the counter-clockwise direction induced by the abrading wheel 15. Alternatively, regulating wheel 28 may also be rotatably driven in a counter-clockwise direction while revolving planetarily in the counter-clockwise direction to further increase the braking effect on the workpiece or even reverse the direction of rotation of the workpiece to further increase the abrading efficiency.

Notably, in both the prior art and the preferred embodiment of the present invention, the axis of workpiece 45 does not lie along the plane formed by the axes of regulating wheel 28 and abrading wheel 15, leading to the term "centerless grinding".

Figure 1:
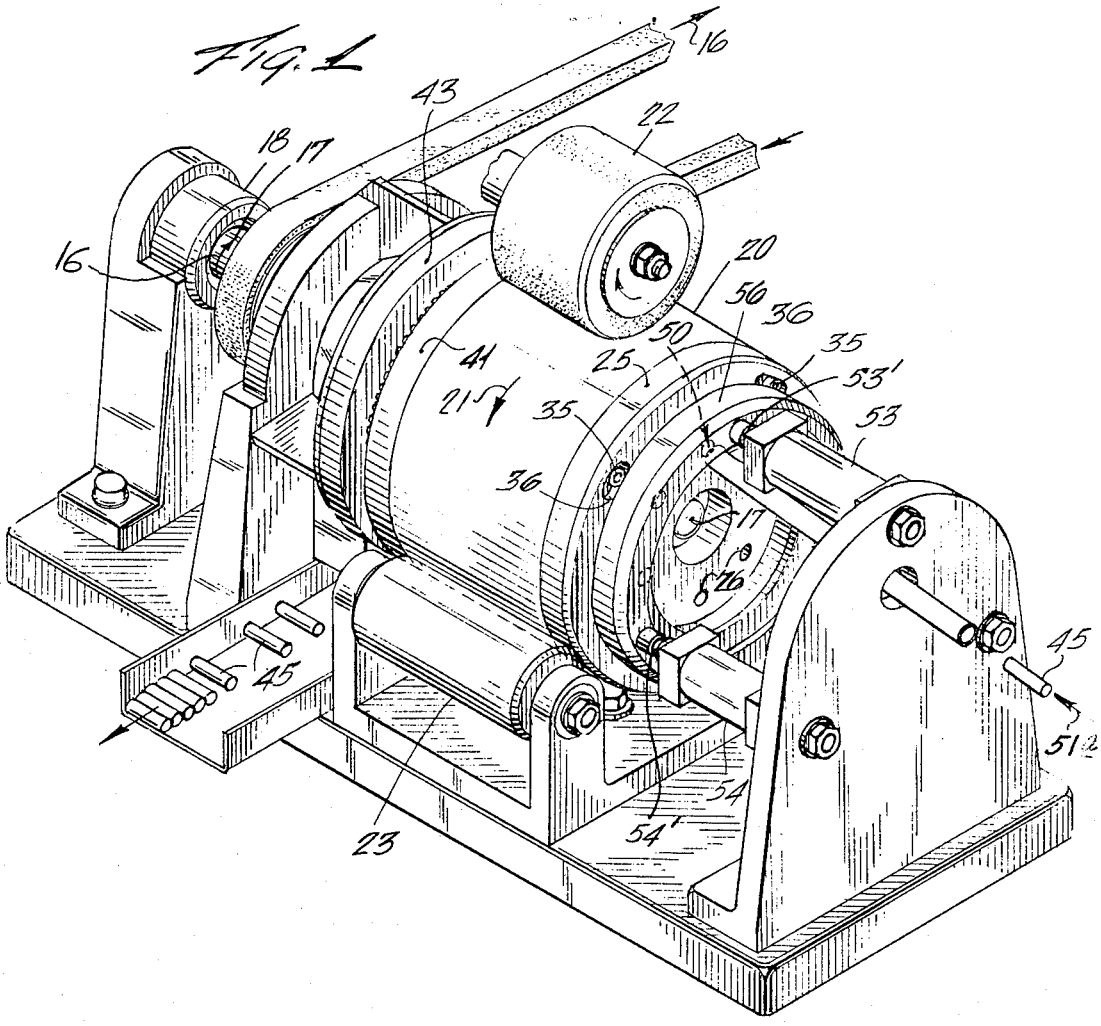
FIG. 1 is a perspective view of a machine for abrading outside diameters of cylindrical workpieces in accordance to the principles of my invention.

Referring to FIG. 1, a perspective view shows the overall relation of the parts. The rotatable housing 20 is rotatably driven in the direction of arrow 21 by wheel 22, which preferably has a high friction surface. A typical roller 23 is rotatably affixed to a frame to provide bottom support and stability for the housing 20. End plate 41 and carrier plate 25 provide enclosure. Plate 25 is adjustably attached to housing 20 by bolts 35 in solts 36. Axial movement of housing 20 is provided by a plurality of pressure means 53 and 54 via shafts 53' and 54', which press against an axially loaded bearing assembly 56 in contact with plate 25.

Shaft 17, on which the abrading wheel is mounted, is driven in the direction of arrow 16 by conventional means, such as the drive belt and pulley shown. The workpieces 45 are fed through the workpiece guide holes 26 in the carrier plate 25 by conventional means 50 in the direction of arrow 50*a*.

Figure 2:
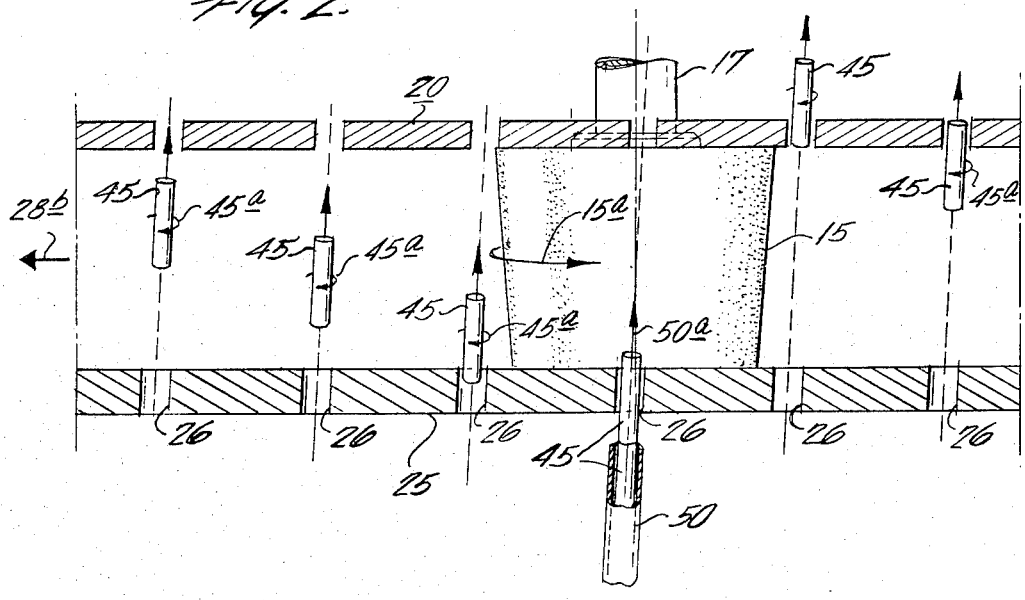
FIG. 2 is a schematic view of the feed and discharge pitch circles shown as a development superimposed over the conical shaped grinding wheel, showing in addition the angular displacement of the workpiece path over the axial center of the grinding wheel and the relative position of the workpiece in its travel across the grinding wheel during one complete revolution.

Referring to FIG. 2, the plurality of holes 26 in carrier plate 25 are shown in a linear mercator type projection, showing the progressive feeding of a workpiece 45 into contact with abrading wheel 15, the workpiece and abrading wheel rotating in the direction of arrows 45*a* and 15*a* respectively, and its passage along the length of 15 to exit from the rear of housing 20. 50 represents the conventional feed means for the workpieces.

Figure 6:
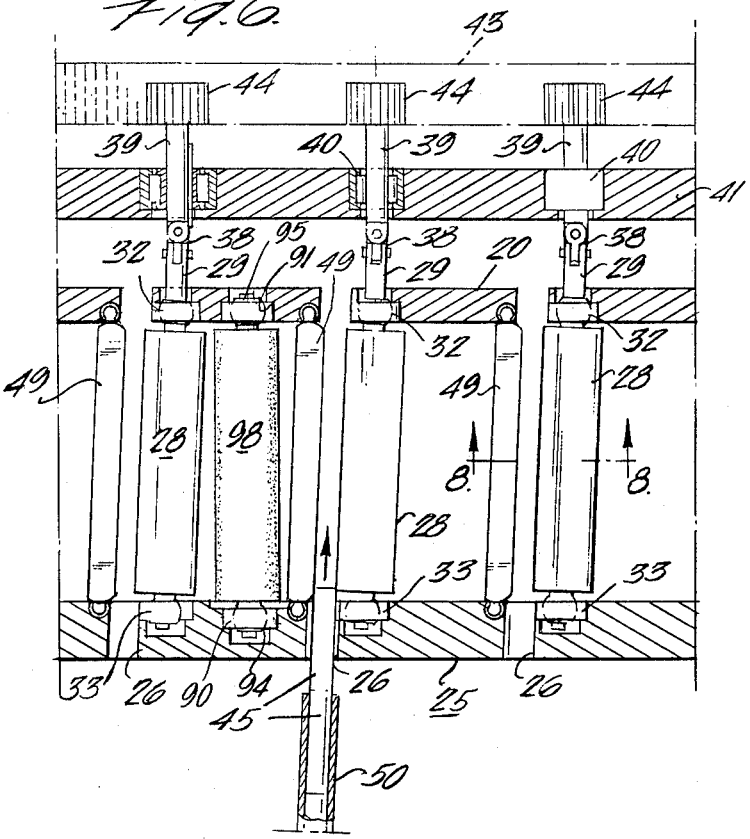
FIG. 6 is a fragmentary sectional development taken on the line 6—6 of FIG. 4 showing the additional details of the regulating wheels, mountings drive means, guide blade and indexing feed station.

Significantly, it should be observed that the regulating wheel axis is preferably set on an angle in relationship to the abrading wheel axis, as shown in FIG. 6. Axial movement of a through-fed workpiece 45 is made possible due to the angle of inclination of the regulating wheels 28.

Figure 3:
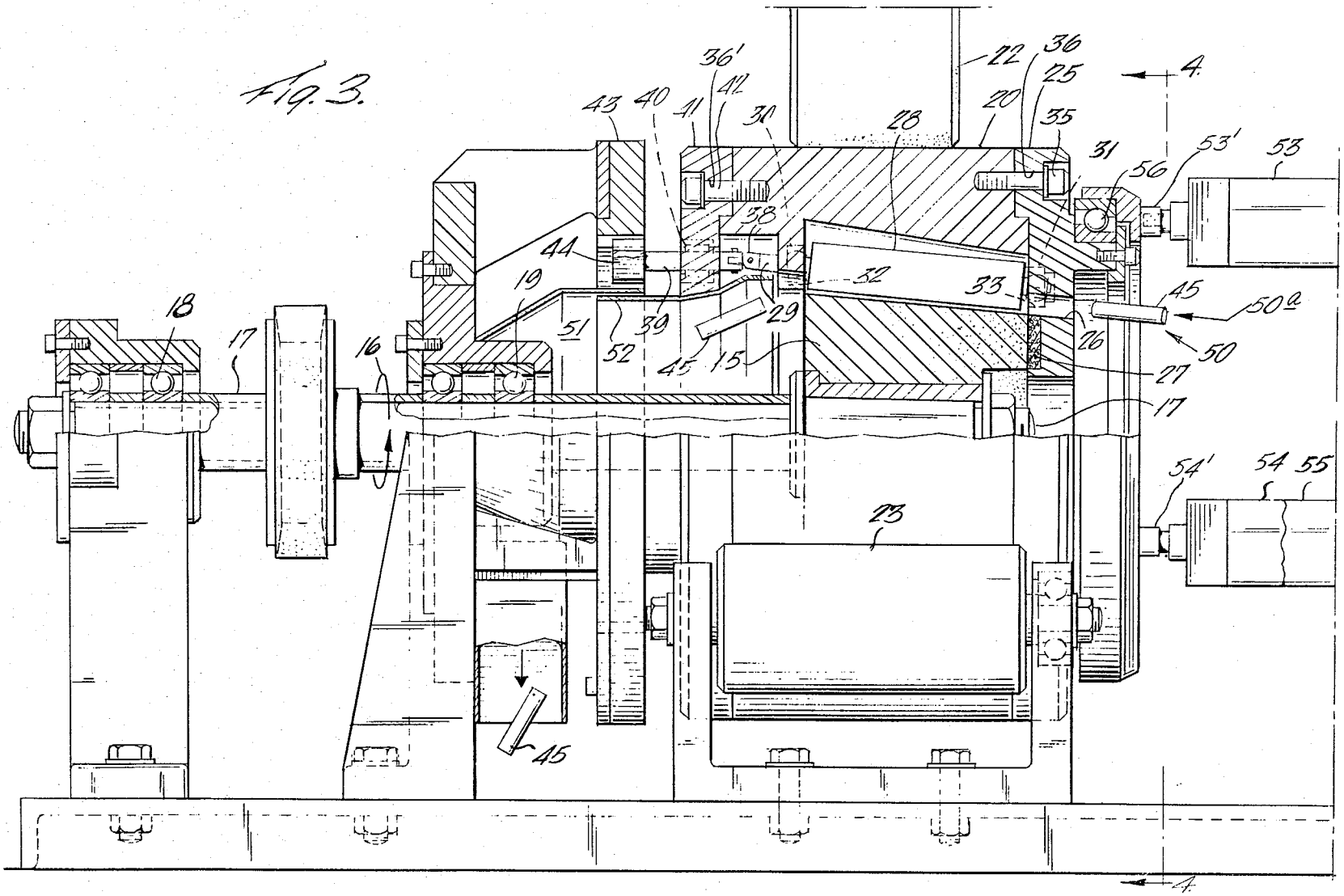
FIG. 3 is a side elevation of the device shown in FIG. 1 with parts in section to show the internal details of my invention.

Referring to FIG. 3, a generally tapered abrading wheel 15 is driven in the direction of arrow 16 by spindle 17 by the conventional means shown in FIG. 1. Spindle 17 is supported by rolling bearings 18 and 19; of which bearing 19 is designed to receive sizeable axial loading. Depending upon the outside diameter profile of the workpiece, other shapes of abrading wheels may be substituted for the abrading wheel that is shown. Additionally, the axially freefloating housing 20, having a cylindrical outside diameter, is driven by roll 22, in the direction of arrow 21 which operates by friction and a generally moderate radial load while contacting housing 20. Housing 20 is supported by free-wheeling rolls, of which 23 is here visible.

Firmly affixed to, and revolving with, housing 20 is the disc-like carrier plate 25, having a thickness which should be approximately one half of the length of the workpieces that are to be abraded. Carrier plate 25 has a plurality of through holes that are depicted by hole 26. Each of the through holes, which radiate toward the outside diameter of the carrier plate, have a uniform diameter that is slightly larger than the diameter of the workpieces to be abraded. The through holes are positioned in a circular pattern, the bolt circle diameter of which is both concentric to, and larger than, the smallest outside diameter of the tapered abrading wheel 15. As the outside diameter of abrading wheel 15 is diminished by the abrading process, housing 20, together with carrier plate 25, will be moved by the described pressure means so that the interior face of carrier plate 25, having a plurality of industrial quality diamond clusters 27, will contact the smaller diameter face of abrading wheel 15. As this occurs, the diamond clusters 27 will resurface the contacting abrading wheel face so that through holes 26 of carrier plate 25 continues to align itself with the smallest outside diameter of the abrading wheel 15. Continuous feeding of production lots of extremely large quantities of workpieces is thereby made possible without interruption.

Figure 5:
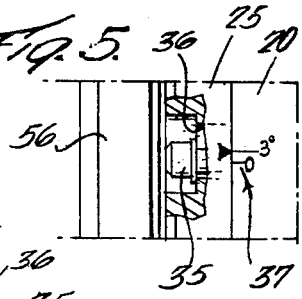
FIG. 5 is a fragmentary sectional view showing an adjustment and indexing detail of my device taken on line 5—5 of FIG. 4.
Figure 7:
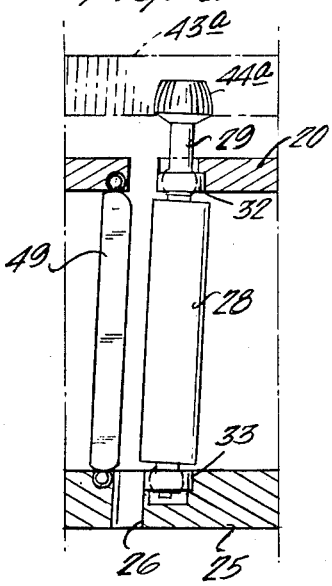
FIG. 7 is a fragmentary sectional view similar to FIG. 6 showing a modified driving means for the regulating wheels.

Also firmly affixed to the housing 20 are a plurality of generally cylindrical regulating wheels as typified by 28 which, for reasons of weight reduction, have uniform diameters that are considerably less than the diameter of conventional regulating wheels. For each carrier plate through hole 26, there is an adjacent regulating wheel 28. Each of the regulating wheels 28 has a shaft 29 which is supported at both ends by rolling bearings 30 and 31. Bearing 31 at the proximal end of regulating wheel 28 is affixed to carrier plate 25, while the bearing 30 at the distal end is affixed to housing 20. The axis of said shaft is set on an angle which corresponds to the half angle of taper of the abrading wheel. These bearings, supporting said shaft, are pressed into the female members of two semi-spherical self-aligning bushings 32 and 33 allowing the regulating wheel 28 to be set on a second angle 37 as shown in FIGS. 5, 6 and 7 to enable the workpieces to feed through the abrading machine. This latter angle 37 has been utilized in the prior art; however, in the preferred embodiment of the present invention, this angle is adjustable by loosening bolts 35 and 42, adjusting the angles of the regulating wheels by adjusting carrier plate 25 and re-tightening said bolts which secure carrier plate 25 through slots 36 and 36'.

FIG. 5 shows the detail of slot 36 in plate 25, bolt 35, bearing assembly 56 and the typical range of adjustment of this angle, 37, by rotation of the plate 25 with respect to housing 20. If desired, degree marks may be placed on plate 25 and housing 20 as shown to aid adjustment.

In FIG. 3, there is shown a universal joint 38 at the distal end of shaft 29, opposite carrier plate 25. Joint 38 joins with shaft 39 while being supported by at least one rolling bearing 40. Further, bearings 40 are affixed to the end of disc-like plate 41 which has at least two bolts that are typified by bolt 42 in slot 36'. As carrier plate 25 is adjusted relative to housing 20, to adjust the angle of the regulating wheel relative to the abrading wheel, plate 41 is similarly rotated in the opposite direction. Thus, the offset angle of the regulating wheel 28 and more especially the regulating wheel shaft 39 is corrected through the pivotal design which the universal joint 38, the self-aligning bushings 32 and 33, and the two disc-like plates, 25 and 41, make possible. In this manner, shaft 39 maintains a perpendicular posture to ring gear 43 which maintains a constant mesh with spur gear 44 of shaft 39 while operational. Gear 43 is slidly affixed to the frame.

Workpieces 45 enter the grinding or lapping machine at the proximal end in the direction of arrow 50*a* through holes 26, engage the contact of both a regulating wheel 28 and the abrading wheel 15, traverse the length of abrading wheel 15 and exit to the distal end into zone 51, as shown. At any given time, as many workpieces are in contact with the abrading wheel as there are regulating wheels, as shown by the end view of FIG. 4. Guard 52 prevents the workpieces from contacting meshing gear teeth of gears 43 and 44, the universal joint 38, or the shaft 39.

Figure 4:
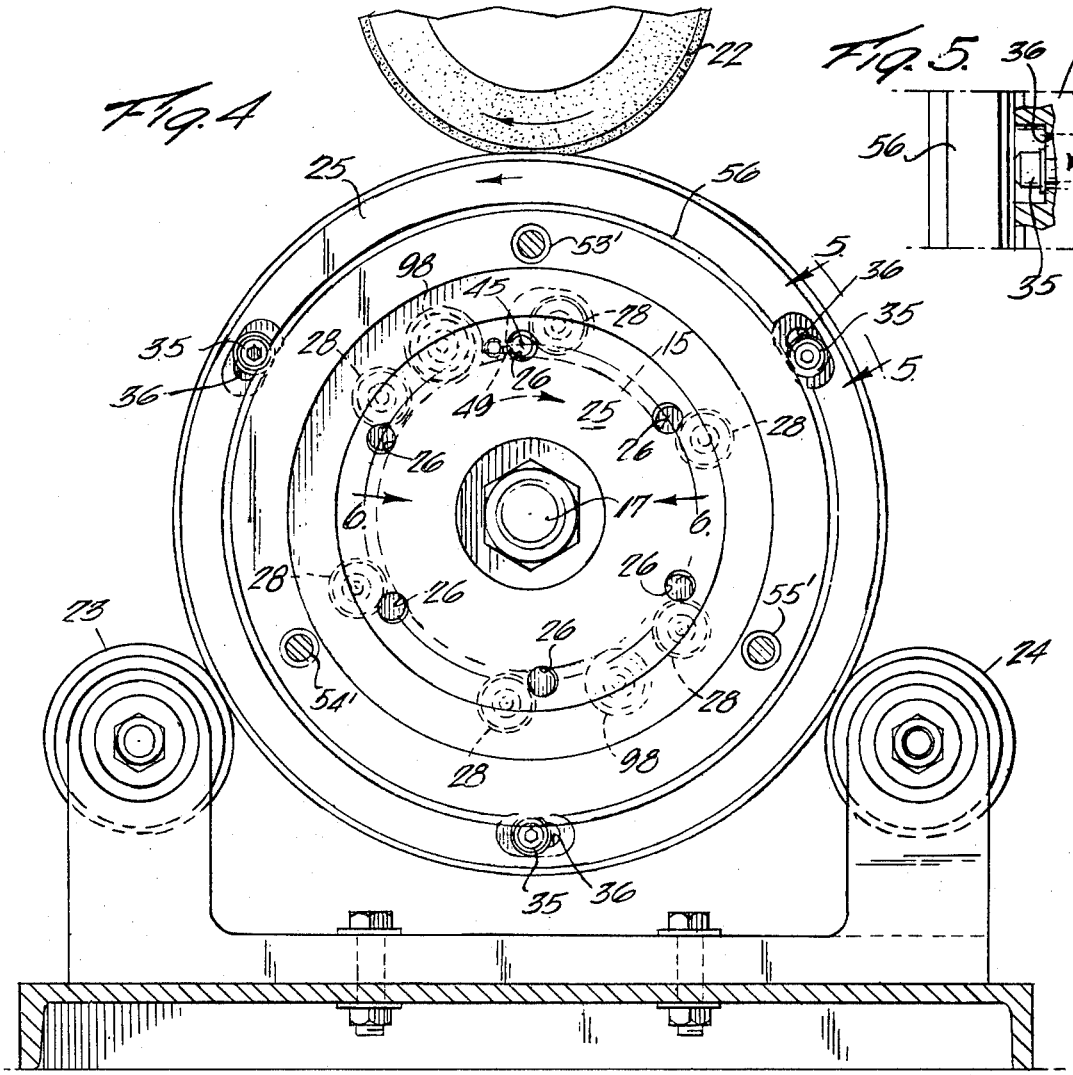
FIG. 4 is a transverse section taken on line 4—4 of FIG. 3.

In FIG. 4, an end view along the sectional lines 4—4 of FIG. 3 is shown. Specifically, the housing 20 is shown supported by rollers 23 and 24, and driven by drive wheel 22. The slots 36 to allow adjustment of plate 25 by loosening of bolts 35 are also shown. The regulating wheels 28 are shown by dotted lines arrayed about the circumference of abrading wheel 15, such regulating wheels 28 and work piece support blades as illustrated by 49 holding the workpieces as illustrated by 45 in abrading contact with the abrading wheel 15. Also shown are the work piece entry holes 26 in plate 25. 53', 54', and 55' are the shaft portions of the pressure cylinders shown in side view in FIG. 3. The abrading wheel 15 is affixed to shaft 17. Also shown in a typical diamond roll 98 held in position as shown in side view in FIG. 6. The axes of roll 98 and shaft 17 (and hence abrading wheel 15) are shown to lie in the plane formed by the line of the axis of said shaft moving radially outward along a line connecting the centers of shaft 17 and diamond roll 98.

In FIG. 6, a fragmentary sectional development view shows the details of the regulating wheels 28, workpieces 45 and workpiece support blades 49, which hold the workpieces 45 in proper alignment and contact with the abrading wheel 15 and regulating wheels 28. The details of shafts 29 and 39, the latter held by bearings 40, connected by universal joint 38, are also shown, as are the meshing of gears 44 to the ring gear 43.

In FIG. 7, however, another embodiment is shown on which universal joint 38 has been deleted to reduce the number of wear points in the present invention. FIG. 7 exhibits a bevel gear 44A at the distal end of shaft 29, opposite carrier plate 25. In operation, bevel gear 44A is constantly engaged with ring gear 43A, whose teeth have the same angle as the regulating wheel axis assumes in its through feeding relationship to the abrading wheel axis. Thus, the gear division of one portion of the invention is distinct from conventional gearing in that helical teeth from a ring gear 43A mesh with the bevel teeth of gear 44A whose axial center line coincides with the helix angle of gear 43A. In this latter gear design, it is preferred that the bevel teeth of gear 44A be convex to assure the greatest portion of contact at the middle to gear 44A. Either of the above gear designs may be employed by the present invention as a matter of choice.

In either instance, however, gear 43 is a nonrotative member that is firmly affixed to the machine frame. However, such a gear is replaceable with other ring gears having alternate helix angles when a helix angle is applicable in other instances. Optional gear designs may employ a rotative ring gear. Regardless of whether the ring gear is rotative or non-rotative, the width of this gear should be substantially longer than the width of gear 44, or gear 44A. This is to allow the meshing contact of gears for an extended period of time as the regulating wheels 28 and their respective assemblies move axially into the taper of the abrading wheel which is progressively diminishing in diameter.

Referring to FIG. 6, as housing 20 revolves, the axes of shafts 39, having gears 44, is caused to rotate due to the engaging contact of gear 43. Regulating wheels 28, being driven by shafts 29, thereby receive rotation in the same direction to that of the abrading wheel. A plurality of workpieces 45 are supported between a plurality of forward blades 49 which are firmly affixed to housing 20 and plate 25. Undoubtedly, the production model machine of the present invention will be appropriately equipped with seals (not shown) which prevent abrasive debris from abrading gears 43 and 44, and other critical working members of the machine.

Referring again to FIG. 3, throughout the grinding or lapping process a plurality of pressure cylinders, depicted here as 53, 54 and 55 exert a constant hydraulic or pneumatic pressure against the sealed thrust bearing assembly 56. Thrust bearing assembly 56 is firmly affixed to the aforementioned pressure cylinders at one end, while being firmly affixed at the other end to carrier plate 25. In this manner, a selfcompensating abrading wheel feature has been designed into the abrading machine: as the abrading wheel diameter reduces from wear, housing 20 will move in the direction of workpiece traverse as shown by arrow 50*a* in response to pressure from 53, 54 and 55, readjusting the tolerance for the workpieces, between the regulating wheels and the abrading wheel.

Alternatives, such as spring pressure, or pressure from weight through leverage may be employed in place of hydraulic or pneumatic pressure. A further alternative of weight alone can be employed if the machine were positioned on a vertical plane rather than the horizontal plane which is illustrated. In this latter instance, pressure cylinders, 53, 54 and 55, and thrust bearing assembly 56 may be deleted from the machine design to further reduce wear parts in the machine. The present invention may therefore be designed so that either horizontal or vertical planes or any variation in between may be utilized.

Figure 9:
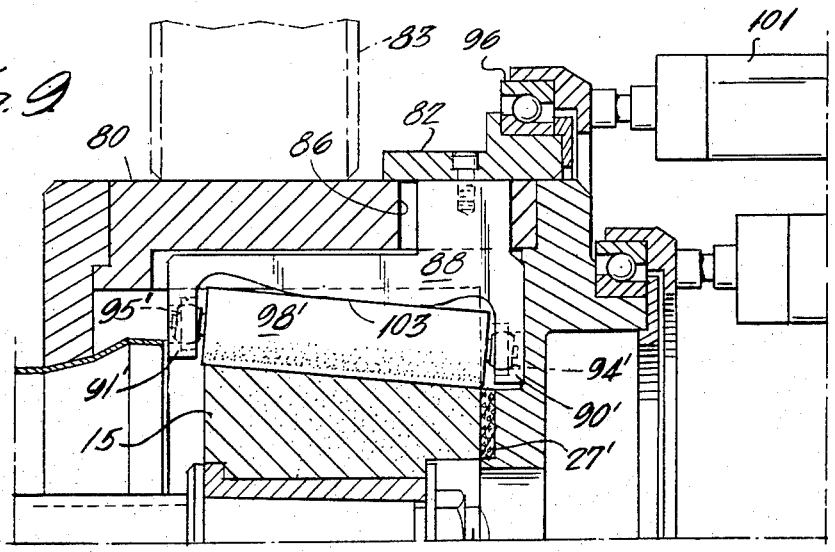
FIG. 9 is a fragmentary sectional elevation showing an additional modification of the device shown in FIGS. 1–8 illustrating mounting and actuating means for the addition of a truing tool.

Referring to FIG. 9, a fragmentary sectional view of FIG. 3, it may be seen that many of the working elements of the machine are the same as those illustrated in FIG. 3, except that the preferred embodiment of a truing mechanism has been added. As a result of the installation of this device, the inside contour of the aforementioned regulating wheel housing, now 80, has been modified to accommodate an axially free-floating diamond truing tool 98'. As in FIG. 3, roll 22 now becomes 83 which is driven by conventional means (not shown) while presenting a generally moderate load on housing 80. Significantly, the regulating wheel housing 80 has been modified with at least two slotted openings, as shown typically by 86, each of which is diametrically balanced, in this instance being 180 degrees opposed. Such slotted openings allow at least two diamond roll supports, such as 88, to protrude through housing 80. Seated in the above diamond roll supports are bushings 90' and 91', which are somewhat resiliently mounted on diamond roll support 88 shown in FIG. 9. Additionally, bearings 94' and 95' are housed in the above bushings while the end portions of the diamond roll 98 are affixed to bearings 94' and 95'. Thus, the diamond roll support 88 supports the diamond roll 98' which resurfaces the abrading wheel 15, preferably while it is rotating. The diamond roll support 88 is in turn affixed to a diamond tool housing 82, which is concentric to housing 80 and axially free floating.

Resurfacing the abrading wheel is accomplished when hydraulic or pneumatic cylinders, such as 101, are extended to exert an axial pressure on the truing tool housing 82 through bearing 96. The diamond tool housing 82 moves in response to such pressure, also moving the diamond roll support 88, actuating said diamond roll into contact with the abrading wheel 15 by means of its resulting axial movement. Before the initial contact between the diamond rolls and abrading wheel occurs, the lower surface 103 of support 88 presents only a slightly amount of pressure on the diamond roll 98', the former having a mating contact on the latter. As the initial contact occurs, however, the high speed rotation of the abrading wheel 15 provides a greater force then the pressure which is presented from surface 103 of the diamond roll support 88. The greater force thereby provides a driving mechanism to drive the free-wheeling roll 98' into rotation. After the initial contact occurs, cylinder 101 is further extended to present a greater pressure on housing 82. This results in additional pressure on the surface 103 which now functions as a brake shoe to regulate the rotation of the diamond roll 98' so that there is enough surface speed variance between the diamond rolls and the abrading wheel speeds to provide an adequate amount of friction to resurface the abrading wheel. After the truing process has been completed, cylinder 101 is retracted, causing the diamond housing 82 to also retract along with the diamond roll 98. The diamond rolls then assume a position just out of contact with the abrading wheel where the rolls will remain while not in use. FIG. 4 further illustrates the location of the truing wheels in the extended position in contact with the abrading wheel.

Should a malfunction, or some other factor, prevent the feeding of workpieces when the present invention is in operation, the regulating wheel housing 80 together with the disc like plate 25, being axially free-floating and having a constant axial pressure against it with no workpieces to align itself against, will be forced axially against the free-floating diamond roll support 88 where the axial movement will be stopped when the diamond roll 98' contacts the abrading wheel 15 at face 103. Thus, the interlock between the truing tool housing 82, disc like plate 25, and the regulating wheel housing 80 is a novel feature of the present invention that provides for a fail-safe mechanism to prevent the workpiece supports from contacting the abrading wheel when workpiece feed problems occur.

An alternative embodiment for the truing mechanism is shown in FIG. 6. In this embodiment, the diamond truing roll 98' is set in bushings 90 and 91 and bearings 94 and 95 mounted to plates 20 and 25 in like fashion to regulating wheels 28, except that the angle between the axes of the diamond roll 98 and the abrading wheel is reduced to zero for truing alignment.

FIG. 6 shows a preset angle for the regulating wheels 28, and adjustment of the plates 20 and 25 to align to the preset angle is accomplished as shown in FIGS. 3, 4, and 5, thereby also setting the diamond roll angle to zero. This embodiment envisions constant contact with the abrading wheel, so that reduction in diameter of the abrading wheel by wear and truing is matched by abrasion of the smaller diameter of the tapered abrading wheel by the diamond clusters 27 in carrier plate 25.

Each of the above improvements that are offered by the present invention may be employed on a variety of machines. Machines which utilize methods such as on-center grinding, above-centered or centerless grinding, centerless lapping and other types of abrading processes are to be included in the methods and machinery which constitute the present invention.

It will thus be seen that the objects set forth above, among those made apparent from the preceding description, are efficiently attained and, since certain changes may be made in carrying out the above method and in the machine set forth without departing from the spirit and scope of the invention, it is intended that all matter contained in the above description and shown in the accompanying drawings shall be interpreted as illustrative and not in a limiting sense.

What I claim is:

1. An improved machine for high speed abrading of outside diameters of the type comprising:

(a) a frame;

(b) an abrading wheel rotatably mounted in the frame;

(c) drive means to rotate the abrading wheel; and (d) workpiece support means affixed to the frame to hold a plurality of workpieces in abrading contact with the abrading wheel;

wherein the improvement comprises:

(e) a housing concentric to the abrading wheel rotatably attached to the frame in which the workpiece support means are attached; and (f) drive means attached to the housing to rotate the housing in a direction opposite to that of the abrading wheel, whereby the counter rotation of the housing causes a revolution of the workpiece support means and the workpieces about the periphery of the abrading wheel in a direction opposite to the rotation of the abrading wheel, increasing the effective grinding speed.

2. The invention of claim 1 wherein the workpiece support means comprises:

(a) a plurality of regulating wheels; and (b) gear means intermeshedly connected at its proximal end to the regulating wheels and at its distal end to the frame whereby upon rotation of the housing containing the regulating wheels a positive rotation is induced in the regulating wheels by the gear means.

3. The invention of claim 2 wherein the axis of the abrading wheel and the axis of any one of the plurality of regulating wheels, such one regulating wheel being in contact with a given workpiece, lie in one plane, while the axis of the given workpiece lies in a separate plane, thereby effecting a centerless abrading operation.

4. The invention of claim 1 wherein the workpiece feed means are affixed adjacent to the proximal end of said housing and workpiece exiting means are affixed adjacent to the distal end of said housing whereby said workpieces are inserted into contact with the proximal end of said abrading wheel, traverse the length of the abrading wheel, and cease contact with the abrading wheel at the distal end of said abrading wheel, thereby effecting a through-feed operation.

5. The invention of claim 2 wherein the housing is axially free floating and wherein variable pressure means are slidably affixed to the housing, whereby in response to pressure from the pressure means the housing moves in axial alignment to the abrading wheel.

6. The invention of claim 5 wherein the housing is substantially enclosed at both ends with disc-like plates, such plates having a plurality of workpiece holes slightly larger than the workpiece diameter for insertion of the work pieces through one plate and exit of the workpieces through the second plate whereby protection is afforded against explosive disintegration of the abrading wheel during operation.

7. The invention of claim 6 wherein the abrading wheel is tapered and said regulating wheels are mounted in said housing so that the angle formed by the axes of the abrading wheel and a given regulating wheel corresponds to the half angle of taper in the abrading wheel.

8. The invention of claim 7 wherein the disc-like plates are adjustably mounted with respect to the housing, and wherein the regulating wheel assemblies are rotatably mounted to said plates, whereby the angle formed by the axis of each regulating wheel and the axis of the abrading wheel, may be adjusted by pivoting and securing said plates to said housing.

9. The invention of claim 8 wherein the regulating wheel assemblies and gearing means comprise:

(a) a plurality of regulating wheel shafts rotatably mounted in said housing each shaft being respectively affixed at its proximal end to one of the regulating wheels so that rotation of the shafts causes rotation of the regulating wheels;

(b) a plurality of regulating wheel shaft gears each respectively affixed to the distal ends of said shafts; and (c) a ring gear affixed to the frame and having intermeshing contact with said regulating wheel shaft gears whereby upon driven rotation of said housing the regulating wheels, regulating wheel shafts and regulating wheel shaft gears are caused to revolve planetarily about the center of said ring gear, thereby simultaneously causing the regulating wheel shaft gears, regulating wheel shafts and regulating wheels to rotate about their respective axes through intermeshed planetary revolution about the ring gear.

10. The invention of claim 9 wherein said regulating wheel shafts each comprise two shafts connected by a universal joint and wherein said regulating wheel shafts are rotatably connected to a plurality of self-aligning bushings affixed to the disc-like plate at the end of the housing proximal to the feed means, and the the distal end of the housing itself, thereby allowing pivoting of the plates for adjustment of the angle of the axes of the regulating wheels with respect to the axis of the abrading wheel.

11. The invention of claim 9 wherein said regulating wheel shafts are rotatably connected to a plurality of self-aligning bushings affixed to the disc-like plate at end of the housing proximal to the feed means and distal end of the housing itself, and wherein said regulating wheel shaft gears are beveled gears, thereby allowing pivoting of the plates for adjustment of the angle of the regulating wheels with respect to the abrading wheel.

12. The invention of claim 7 wherein the workpiece holes in the disc-like plate enclosing the proximal end of the housing are of circular shape with a uniform diameter slightly larger than the diameter of the workpieces to be abraded, the centers of such workpiece holes being positioned in a circular pattern, concentric to the circumference of the abrading wheel, and the diameter of which is larger than the smallest diameter of the tapered abrading wheel.

13. The invention of claim 12 wherein the disc-like plate enclosing the proximal end of the housing has, on the side facing the abrading wheel, a plurality of industrial quality diamonds in abrading contact with the smallest diameter face of the tapered abrading wheel and wherein axial pressure means are affixed to the proximal end of said housing whereby, upon axial movement of the housing in response to the axial pressure means, the smallest diameter face of the tapered abrading wheel is abrasively contacted by the diamond faced disc-like plate, thereby increasing the smallest diameter of said tapered abrading wheel to offset any reductions in such smallest diameter caused by abrading contact with the workpieces, thereby keeping the workpiece feed holes in said disc-like plate in alignment with the circumference of the smallest diameter face of the tapered abrading wheel.

14. The invention of claim 7 wherein a generally cylindrical truing tool in constant abrading contact with the lengthwise circumference of the abrading wheel is rotatably mounted to the inside of a truing tool housing, which in turn is rotably mounted for rotation independent of the housing for the regulating wheels, whereby upon rotation of the housing the truing tool revolves about the circumference of the abrading wheel, thereby truing the circumferential surface of said abrading wheel while the workpieces are being ground.

15. The invention of claim 5 wherein the pressure means are hydraulic.

16. The invention of claim 5 wherein the pressure means are mechanical.

17. The invention of claim 1 wherein the housing has openings, and wherein a plurality of axially extendable truing tools responsive to pressure means attached to the frame are placed in the housing openings whereby in response to pressure from the pressure means the truing tools are extended into abrading and truing contact with the abrading wheel.

18. A method for abrading the outside diameters of workpieces which comprises:

(a) introducing a workpiece into abrading contact with a rotating abrading wheel;

(b) holding the workpiece in contact with the abrading wheel with workpiece support means; and (c) revolving the workpiece support means 360° about the periphery of the abrading wheel in a direction opposite to that of the abrading wheel rotation, thereby increasing the effective surface grinding speed.

19. The invention of claim 18 further comprising rotating the workpieces about their axes by rotating the workpiece support means in the same direction as the abrading wheel rotation.

20. The invention of claim 18 further comprising rotating the workpiece about their axes by rotating the workpiece support means in the opposite direction to the abrading wheel rotation.

21. The invention of claim 18 further comprising truing the abrading wheel during operation by extending a revolving truing tool into abrading contact with the abrading wheel.

* * * * *